US008590439B2

(12) United States Patent
White et al.

(10) Patent No.: US 8,590,439 B2
(45) Date of Patent: Nov. 26, 2013

(54) BARRIER

(71) Applicant: Defenshield, Inc., East Syracuse, NY (US)

(72) Inventors: William Collins White, Cicero, NY (US); John Kleniatis, Jamesville, NY (US)

(73) Assignee: Defenshield, Inc., East Syracuse, NY (US)

( * ) Notice: Subject to any disclaimer, the term of this patent is extended or adjusted under 35 U.S.C. 154(b) by 0 days.

(21) Appl. No.: 13/736,326

(22) Filed: Jan. 8, 2013

(65) Prior Publication Data

US 2013/0284002 A1 Oct. 31, 2013

Related U.S. Application Data

(63) Continuation of application No. 13/183,880, filed on Jul. 15, 2011, now Pat. No. 8,371,207, which is a continuation of application No. 12/115,283, filed on May 5, 2008, now Pat. No. 8,001,880.

(60) Provisional application No. 60/916,099, filed on May 4, 2007.

(51) Int. Cl.
*F41H 5/24* (2006.01)

(52) U.S. Cl.
USPC ..... 89/36.04; 89/36.01; 89/920; 404/6

(58) Field of Classification Search
USPC ..... 89/36.04, 36.01, 920; 404/6
See application file for complete search history.

(56) References Cited

U.S. PATENT DOCUMENTS

| | | | |
|---|---|---|---|
| 772,055 | A | 10/1904 | Post |
| 1,253,964 | A | 1/1918 | Hack |
| 1,261,518 | A | 4/1918 | Hahre |
| 1,274,721 | A | 8/1918 | Krzan |

(Continued)

FOREIGN PATENT DOCUMENTS

| | | | |
|---|---|---|---|
| DE | 2412568 | A1 | 9/1975 |
| EP | 1172484 | * | 1/2002 |

(Continued)

OTHER PUBLICATIONS

Mifram Security—Body Guard; www.miframsecurity.com; Aug. 2007.

(Continued)

*Primary Examiner* — J. Woodrow Eldred
(74) *Attorney, Agent, or Firm* — Woodcock Washburn LLP

(57) ABSTRACT

A barrier that includes attack resistant pane(s) (see DEFINITIONS section). In this way, a person behind the barrier can be protected when they are outside. More specifically, the person behind the barrier is protected, at least to some extent, from both: (i) vehicular attacks; and (ii) blast (for example, bombs) and/or ballistic (for example, bullet) attacks. Also, the protected person can see what is happening across the barrier because of the attack-resistant pane(s). Also, if the barrier is unanchored then it can be moved from place to place, for example, by heavy equipment, so that the same barrier can be re-deployed at different outdoor locations (or indoor locations) on an as-needed basis. Preferably, the barrier also includes framing pieces that secure the attack-resistant pane(s) to the body of the barrier, with the framing pieces being covered on one side by an attack-resistant material (preferably, hardened steel).

20 Claims, 3 Drawing Sheets

(56) References Cited

U.S. PATENT DOCUMENTS

| | | | |
|---|---|---|---|
| 1,281,400 | A | 10/1918 | Larnell |
| 1,465,042 | A | 8/1923 | Hruska |
| 1,875,488 | A | 6/1931 | Peters |
| 2,370,596 | A | 2/1945 | Wallace |
| 2,613,243 | A | 10/1952 | Frear |
| 2,845,153 | A | 7/1958 | West |
| 2,985,174 | A | 5/1961 | Guth |
| 3,039,161 | A | 6/1962 | Gagnon |
| 3,590,685 | A | 7/1971 | Lane |
| 3,942,598 | A | 3/1976 | Council |
| 3,994,243 | A | 11/1976 | Anders |
| 4,030,219 | A | 6/1977 | Donovan |
| 4,061,093 | A | 12/1977 | Carstens, Jr. et al. |
| 4,214,411 | A | 7/1980 | Pickett |
| 4,245,546 | A | 1/1981 | Chaires |
| 4,351,558 | A | 9/1982 | Mueller |
| 4,416,485 | A | 11/1983 | Long |
| 4,674,394 | A | 6/1987 | Martino |
| 4,781,101 | A | 11/1988 | Zevuluni et al. |
| 4,901,964 | A | 2/1990 | McConnell |
| 4,949,490 | A | 8/1990 | Miller |
| 4,953,820 | A | 9/1990 | Yoder |
| 5,244,172 | A | 9/1993 | Allega |
| 5,293,807 | A | 3/1994 | Haidu |
| 5,368,904 | A | 11/1994 | Stephinson |
| 5,419,479 | A | 5/1995 | Evels et al. |
| 5,438,908 | A | 8/1995 | Madden, Jr. |
| 5,560,149 | A | 10/1996 | Lafevre |
| 5,703,316 | A | 12/1997 | Madden, Jr. |
| 5,857,730 | A | 1/1999 | Korpi et al. |
| 5,878,519 | A | 3/1999 | Huyck et al. |
| 6,000,347 | A | 12/1999 | Madden, Jr. |
| 6,082,240 | A | 7/2000 | Middione et al. |
| 6,116,326 | A | 9/2000 | Domina et al. |
| 6,333,085 | B1 | 12/2001 | Emek |
| 6,622,607 | B1 | 9/2003 | Miller |
| 6,907,811 | B2 | 6/2005 | White |
| 6,962,461 | B2 | 11/2005 | Choi et al. |
| 7,069,680 | B1 | 7/2006 | Crawford |
| 7,104,720 | B2 | 9/2006 | Humphries et al. |
| 7,128,308 | B2 | 10/2006 | Marsh et al. |
| 8,001,880 | B2 | 8/2011 | White et al. |
| 8,371,207 | B2 | 2/2013 | White |
| 2003/0167911 | A1 | 9/2003 | White |
| 2004/0255769 | A1 | 12/2004 | Drackett |
| 2005/0265780 | A1 | 12/2005 | Humphries et al. |
| 2006/0000671 | A1 | 1/2006 | Nolley |

FOREIGN PATENT DOCUMENTS

| | | | |
|---|---|---|---|
| EP | 1172484 | A2 | 1/2002 |
| EP | 2156137 | A2 | 2/2010 |
| FR | 2607238 | A1 | 5/1988 |
| WO | WO 94/29665 | | 12/1994 |
| WO | WO 2007/009134 | A1 | 1/2007 |
| WO | WO 2009/023310 | | 2/2009 |

OTHER PUBLICATIONS

Ballistic Resistant Protective Materials NIJ Standard 0108.01—The National Institute of Justice of the U.S. Department of Justice; http://wvvw.eeel.nist.gov/oles/Publications/NIJ-0108.01.gdf; as of May 3, 2008.

http://www.govsupply.com/Products/GSATest.cfm; as of May 3, 2008.

http://www.govsupply.com/Docs/TestReports/GSATestingStandardMernorandum.pdf; as of May 3, 2008.

http://www.govsupply.com/Docs/TestReports/GSATestingStandard.pdf; as of May 3, 2008.

Mifram Security—Bodyguard-Pro; http://www.tactical-life.com/online/products/mifram-securitys/; Nov. 2008.

International Patent Application No. PCT/US2008/062693: International Search Report dated Jul. 1, 2009, 13 pages.

Bullet-Resisting Equipment UL 752—Underwriters' Laboratories; http://ulstandardinfonet.ul.com/scopes/scopes.asp?fn=0752.html; as of May 3, 2008.

European Patent Application No. 08827279.4: Examination Report dated Sep. 20, 2013, 4 pages.

* cited by examiner

BARRIER

CROSS-REFERENCE TO RELATED APPLICATIONS

This application is a continuation of U.S. patent application Ser. No. 13/183,880 filed Jul. 15, 2011 which is a continuation of U.S. patent application Ser. No. 12/115,283 filed May 5, 2008, now U.S. Pat. No. 8,001,880 issued Aug. 23, 2011 which claims benefit to U.S. Provisional Patent Application No. 60/916,099 filed May 4, 2007, the disclosures of which are hereby incorporated by reference herein in their entireties.

BACKGROUND OF THE INVENTION

1. Field of the Invention

The present invention relates to attack-resistant panes (see DEFINITIONS section) and to barriers (see DEFINITIONS section) and unanchored barriers (see DEFINITIONS section).

2. Description of the Related Art

Attack-resistant panes are conventional. An attack resistant pane may be ballistic resistant, blast resistant, or both. The degree of ballistic resistance is sometimes rated under one of the following standards: (i) "Ballistic Resistant Protective Materials NIJ Standard 0108.01" by the National Institute of Justice of the U.S. Department of Justice (published at http://www.eeel.nist.gov/oles/Publications/NIJ-0108.01.pdf as of May 3, 2008 and herein incorporated by reference); and (ii) "Bullet-resisting Equipment UL 752" by Underwriters' Laboratories (published at http://ulstandardinfonet.ul.com/scopes/scopes.asp?fn=0752.html as of May 3, 2008 and herein incorporated by reference). The degree of blast resistance is sometimes rated under the following standard: GSA Testing Standard (published at the following websites (i) http://www.govsupply.com/Products/GSATest.cfm; (ii) http://www.govsupply.com/Docs/TestReports/GSATesting-StandardMemorandum.pdf; and (iii) http://www.govsupply.com/Docs/TestReports/GSATestingStandard.pdf as of May 3, 2008 and are herein incorporated by reference.) It is noted that these standards of ballistic resistance and blast resistance are applicable not just to attack resistant panes, but more broadly to any attack resistant panel, such as an opaque panel. Conventionally, attack resistant panes are made of acrylic or glass, often reinforced with polycarbonate. Conventionally, attack resistant panes are usually a couple inches thick, but may be thinner depending on material used, degree of blast resistance required, degree of ballistic resistance desired and application. Conventional applications of attack resistant panes include external windows of buildings, internal windows of buildings and military vehicle windows.

Barriers and unanchored barriers are conventional. For example, one well known type of barrier, commonly used to direct vehicular traffic flow, is called a Jersey barrier. One conventional anchored barrier is the security bollard.

U.S. Pat. No. 7,104,720 ("Humphries 1") discloses a traffic noise barrier including a longitudinal barrier portion and panels. The panels may be made of a transparent material, such as PARAGLASS SOUNDSTOP acrylic sheet available from CYRO Industries. The transparent panels of the barrier of Humphries 1 are not disclosed to be attack-resistant.

US published patent application 2004/0255769 ("Drackett") discloses a mobile personal gunfire shield. The Drackett shield is attack-resistant, but it is not a barrier.

US published patent application 2005/0265780 ("Humphries 2") discloses a crashworthy traffic noise barrier including a longitudinal barrier portion, upstanding posts, longitudinal beams and panels. The panels may be reinforced with plastic threads, walls or net, and are designed to remain attached to the barrier, even in the event of a crash. The panels may be made of a transparent material, such as a cast acrylic glass panel with embedded plastic threads. The transparent panels of the barrier of Humphries 2 are not disclosed to be attack-resistant.

Description of the Related Art Section Disclaimer: To the extent that specific publications are discussed above in this Description of the Related Art Section, these discussions should not be taken as an admission that the discussed publications (for example, published patents) are prior art for patent law purposes. For example, some or all of the discussed publications may not be sufficiently early in time, may not reflect subject matter developed early enough in time and/or may not be sufficiently enabling so as to amount to prior art for patent law purposes. To the extent that specific publications are discussed above in this Description of the Related Art Section, they are all hereby incorporated by reference into this document in their respective entirety(ies).

BRIEF SUMMARY OF THE INVENTION

The present invention is directed to barriers that include attack resistant pane(s). In this way, a person behind the barrier can be protected when they are outside. More specifically, the person behind the barrier is protected, at least to some extent, from both: (i) vehicular attacks; and (ii) blast (for example, bombs) and/or ballistic (for example, bullet) attacks. Also, the protected person can see what is happening across the barrier because of the attack-resistant pane(s). Also, if the barrier is unanchored then it can be moved from place to place, for example, by heavy equipment, so that the same barrier can be re-deployed at different locations on an as-needed basis. Preferably, the barrier also includes framing pieces that secure the attack-resistant pane(s) to the body of the barrier, with the framing pieces being covered on one side by an attack-resistant material (preferably, hardened steel).

Various embodiments of the present invention may exhibit one or more of the following objects, functional features and/or advantages:

(1) pre-existing non-attack-resistant barriers (for example, standard jersey barriers) can be retrofit to be used in preferred attack-resistant barriers according to the present invention;

(2) a ballistic/blast resistant barrier is provided that is able to be implemented quickly, such as in dangerous situations;

(3) a ballistic/blast resistant barrier is provided that affords complete ballistic/blast resistant coverage to the entire body of an individual or team without restricting vision;

(4) a ballistic/blast resistant barrier is provided that may be conveniently broken down (and set-up) for ease of transport and maintenance;

(5) armor panels that may be slid into or out of the bracket assembly facilitate convenient break-down and set-up of the unit, or repair or replacement of damaged armor sections;

(6) superior protection from ballistic impacts;

(7) superior protection from blast forces; and (8) superior protection from vehicle impacts.

According to one aspect of the present invention, an attack-resistant barrier includes a barrier member, a cap and an upper wall. The barrier member is shaped as a Jersey barrier and includes a relatively narrow cap engaging portion and a relatively wide lower portion. The cap includes: (i) a barrier engaging portion shaped and located to wrap around the cap engaging portion; and (ii) a trough. The upper wall defines an attack side major surface and a protected side major surface.

The upper wall includes: (i) a lower edge region mechanically connected to the trough; (ii) at least one attack-resistant pane having multiple pane edges; (iii) multiple channel members shaped and located to wrap around at least some of the pane edges; and (iv) multiple armor strips shaped and located on at least the attack side major surface as a facing over at least a portion of the channel members.

According to another aspect of the present invention, an attack-resistant barrier includes: a barrier member, and an attack-resistant wall. The barrier is adapted to act as a barrier (see DEFINITIONS section). The attack-resistant wall is mechanically connected to the barrier. The attack-resistant wall includes: at least one attack-resistant pane, and an attack-resistant opaque portion located around at least a portion of the attack-resistant pane.

According to another aspect of the present invention, an attack-resistant barrier includes a barrier member, an attack-resistant wall, attack resistant pane(s), channel members and armor strips. The barrier member is adapted to act as a barrier. The attack-resistant wall is mechanically connected to the barrier. The attack-resistant wall defines an attack side major surface and a protected side major surface. The attack-resistant wall includes: (i) at least one attack-resistant pane having multiple pane edges; (ii) multiple channel members shaped and located to wrap around at least some of the pane edges; and (iii) multiple armor strips shaped and located on at least the attack side major surface as a facing over at least a portion of the channel members.

BRIEF DESCRIPTION OF THE DRAWINGS

The present invention will be more fully understood and appreciated by reading the following Detailed Description in conjunction with the accompanying drawings, in which.

DETAILED DESCRIPTION OF THE INVENTION

Figure 1:
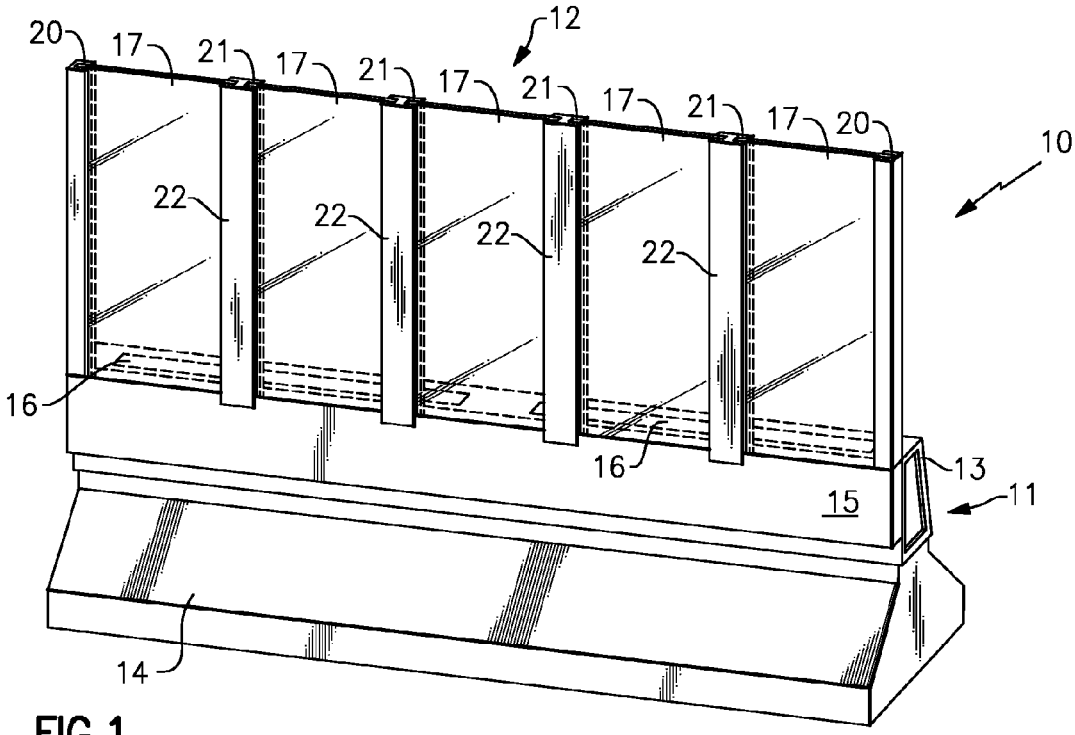
FIG. 1 is a front view that illustrates a barrier according to a first embodiment of the present invention.
Figure 2:
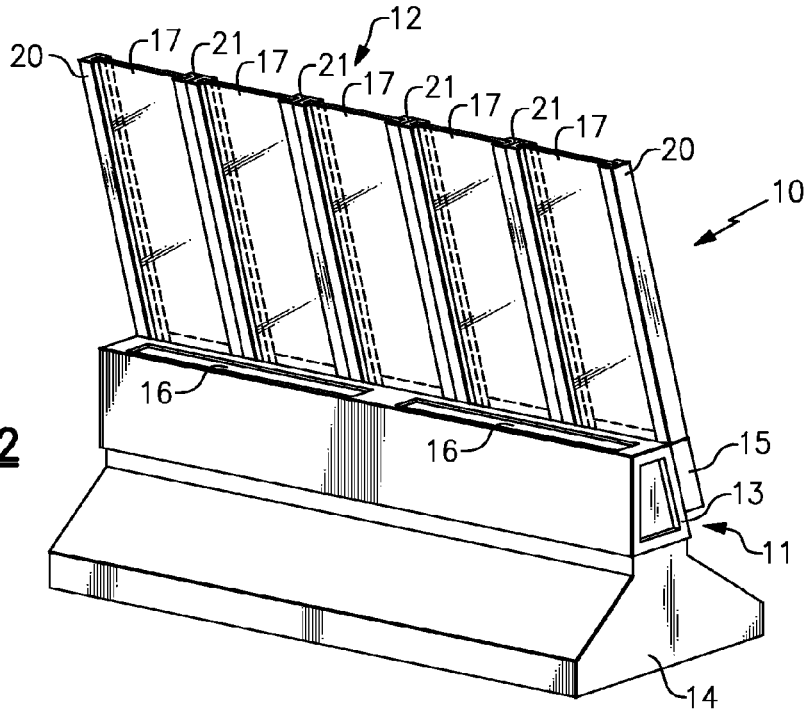
FIG. 2 is a rear view of the first embodiment barrier.
Figure 3:
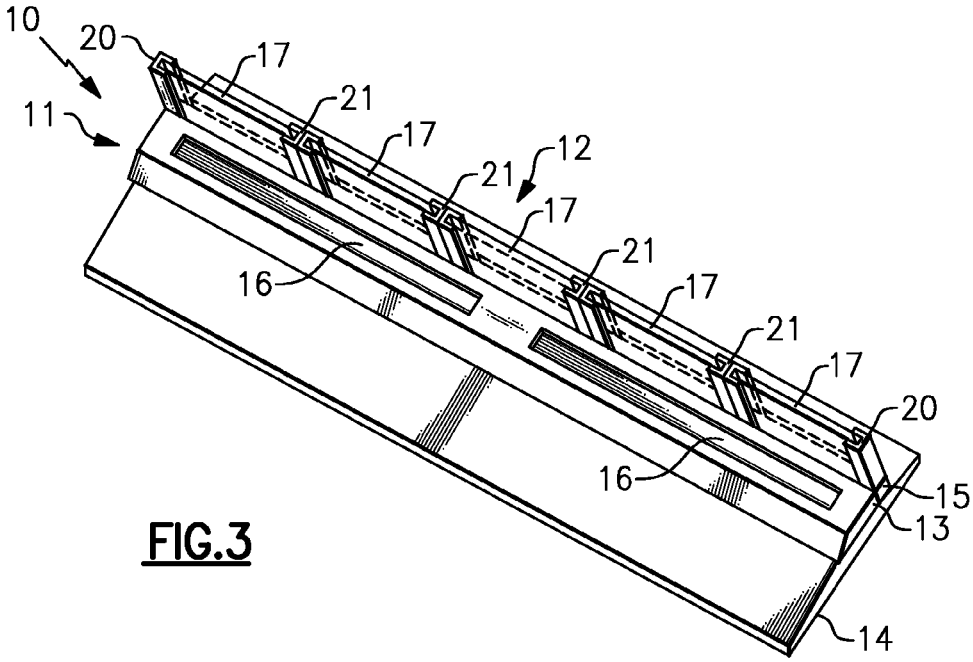
FIG. 3 is a top view of the first embodiment barrier.

FIGS. 1 to 3 show barrier 10, including: base unit 11; and upper wall 12. The base unit includes: cap 13; barrier portion 14; trough 15; and cut-outs 16. The upper wall includes attack-resistant panes 17; C-shaped channel 20; double C-channel members 21; and armor strips 22. The barrier portion of barrier 10 is shaped as a conventional Jersey barrier. The cap is engaged with the top of the barrier portion. The upper wall extends from the top of the cap in the upwards direction. Preferably, the barrier portion itself is pre-existing. For example, a pre-existing Jersey barrier could be retrofit with a cap and an upper wall. Even if the barrier portion itself is new, it may be made according to a pre-existing and/or mass produced barrier design. Barrier 10 may be conveniently broken down (and set-up) for ease of transport and maintenance.

Barrier portion 14 is preferably composed of a material, such as metal, plastic, ceramic or a composite material. Upper wall 12 is removably interconnected to the cap. A series of holes (not shown) around the perimeter of the cap allow for the cap to be permanently secured to the barrier portion by fasteners (not shown), such as lags, anchor bolts, "drop ins," or the like. The weight of the cap and its wrap-around engagement with the top of the barrier portion also help provide reliable securement of the cap and upper wall to the barrier portion. In some embodiments the weight and/or friction may be sufficient to secure the cap and eliminate the need for separate fasteners in this mechanical connection. This is important because the barrier is meant to protect against vehicular impacts, as well as ballistic and/or blast impacts.

The cut-outs in the top of the cap allow the barrier to be moved after the cap is installed to form the base unit. Preferably, the heavy concrete barrier portion has lifting grips (not shown) for lifting, where the lifting grips align with the cut-outs in the cap so that the grips protrude through the cut-outs and/or can be accessed through them. For example, these lifting grips may take the form of metal bars or wire loops anchored in the concrete of the barrier portion.

Trough 15 is formed as a separate piece that is attached to the rest of the cap and is considered to form a part of the finished cap. Preferably the trough is welded to the rest of the cap, but other types of mechanical connections may be possible. Alternatively, the trough could be formed as a single unitary piece with the rest of the cap. The trough is used to hold the upper wall. A series of holes (not shown) under the trough allow for the drainage of any moisture that otherwise may build up in the trough.

The attack-resistant panes 17 are composed of an attack-resistant material, such as plastic, acrylic, glass, polycarbonate-reinforced acrylic and/or polycarbonate reinforced glass. Alternative embodiments of the present invention may include only a single pane and/or have pane(s) of substantially different geometries than panes 17. Some trade names of suitable materials (which may be registered trademarks in some jurisdictions) are: Armortex; Frag-Stop; Hygard and Acryshield. Manufacturers of suitable attack-resistant pane materials include: North American Specialty Glass, Trumbauersville, Pa. USA and SABIC Innovative Plastics (formerly GE Plastics).

For handgun rounds we use a laminated polycarbonate/acrylic generally supplied by SABIC Innovative Plastics (formerly GE Plastics) The panes are secured to each other and to the cap by framing pieces 20, 21, 22 (sometimes referred to as a support network) to form the upper wall. It is this upper wall that makes the plain old barrier into an attack-resistant barrier, according to the present invention, because the attack-panes provide some degree of blast and/or ballistic protection, while still allowing protected people on one side of the barrier to see what is going on on the other side of the barrier.

The support framework includes a C-shaped channel 20 located at each side end the upper wall 12, as shown in FIG. 1. Channel 20 is mechanically connected to the trough portion of the cap by an appropriate fastener. The bracket assembly further includes H-shaped double C-channel members 21, which are also attached to the trough by an appropriate fastener. These members 21 interconnect the ballistic/blast resistant transparent armor panels. Both the channels 20 and the members 21 are preferably made of a material that is rigid, but still relatively easy to form and shape, such as plain carbon steel. Channels 20 and members 21 do not need to be made from blast resistant and/or ballistic resistant material (sometimes referred to as armor), which is good because these pieces are difficult to manufacture from armor material.

Preferably, channels 20 and members 21 include a gasket within their channels interposed over at least a part of the surface area that interfaces with the panes. The gasket can help absorb mechanical shocks due to vehicle impacts, ballistic impacts and/or blast forces. Preferably, the gasket is made of rubber. Because of the C and H shapes of the pieces 20 and 21, the panes may be slid into or out of the support framework. This facilitates convenient break-down and set-up of the unit, or repair or replacement of damaged armor sections. A soap solution may be used to lubricate the panes when they are slid into and/or out of the support framework.

The surfaces of pieces 20, 21 facing at least one major surface of the upper wall (called the attack side) are covered with a facing in the form of armor strips 22. As their name implies, the armor strips are, because of their thickness and material choice, blast and/or ballistic resistant. Alternatively the armor strip facing can be used at both major surfaces of the upper wall. Armor strips 22 are made of hardened steel. Alternatively, the armor strips can be made of other materials, such as metal, plastic, ceramic or a composite material. The armor strips are used to cover gaps (or shield seams) between the panes 17. These armor strips are welded to channels on the front of the barrier and fit over the trough at the bottom of the panes.

Preferably the framing pieces, armor strips and trough are mechanically connected by welding at their mechanical interfaces, but other types of mechanical connections may be possible.

Between the thick concrete barrier, the attack resistant panes, and the armor strips, barrier 10 forms a wall that is blast and/or ballistic resistant comprehensively over its entire major surface area. This is important because it is undesirable to have a bullet and/or shrapnel get through any chink in the armor. This provides comprehensive protection to the people behind the barrier (sometimes referred to as the protected side). Because the upper wall makes barrier 10 significantly taller than a plain Jersey barrier, a person's entire body can be protected from forces that are vectoring substantially parallel to the ground. This provides good protection to the front of a person standing on the protected side.

The panes, armor strips and barrier portion (sometimes collectively called the armored components) should at least provide a degree of ballistic resistance or blast resistance so that the barrier a be considered to be attack resistant, unlike the barrier of Humphries 2, discussed above. More preferably, for ballistic resistant barriers, the armored components should be rated at least NIJ-I (see National Institute of Justice Standards discussed above), which is considered sufficient to stop a bullet from a .22 caliber gun. Even more preferably, for ballistic resistant barriers, the armored components should be rated at least UL Threat Level One (see Underwriters' Laboratories Standards discussed above), which is considered sufficient to stop a bullet from a 9 mm caliber gun.

Barrier 10 is not anchored to the ground, which means that it is "portable" (see Definitions section). It is the mass and shape of the Jersey barrier portion that really makes barrier 10 a barrier (see DEFINITIONS section), as opposed to a mere attack-resistant wall. Alternatively, some barriers according to the present invention could be anchored to the ground and/or pre-existing man-made structures, with the anchoring helping the barrier to act as a barrier.

Figure 4:
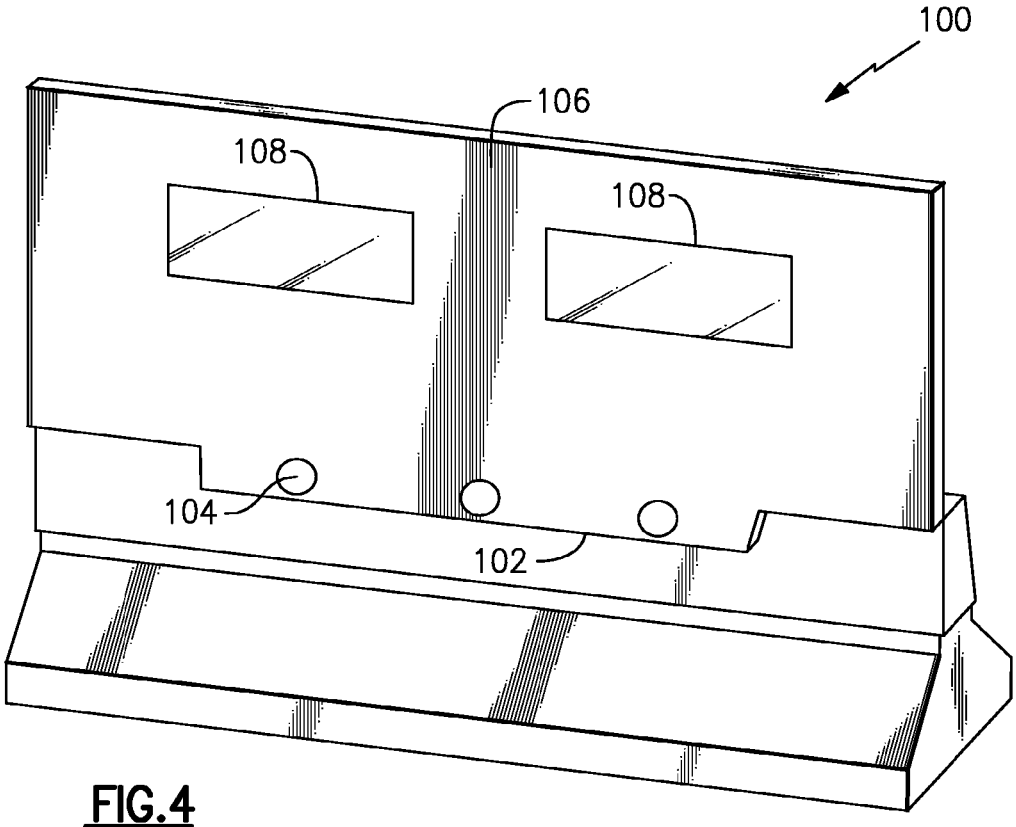
FIG. 4 is a front view of a barrier according to a second embodiment of the present invention.

FIG. 4 shows attack-resistant barrier 100, including flange 102; fastener 104; opaque portion 106; and attack-resistant windows 108. The flange and fasteners show an alternative, although not necessarily preferred, structure for attaching an attack-resistant device to the top of a barrier, such as a Jersey barrier. Preferably, the opaque portion is ballistic resistant and/or blast resistant. In fact, the use of opaque materials may result in a higher degree of ballistic resistance and blast resistance due to the decreased use and surface areas of substantially transparent attack-resistant material.

Figure 5:
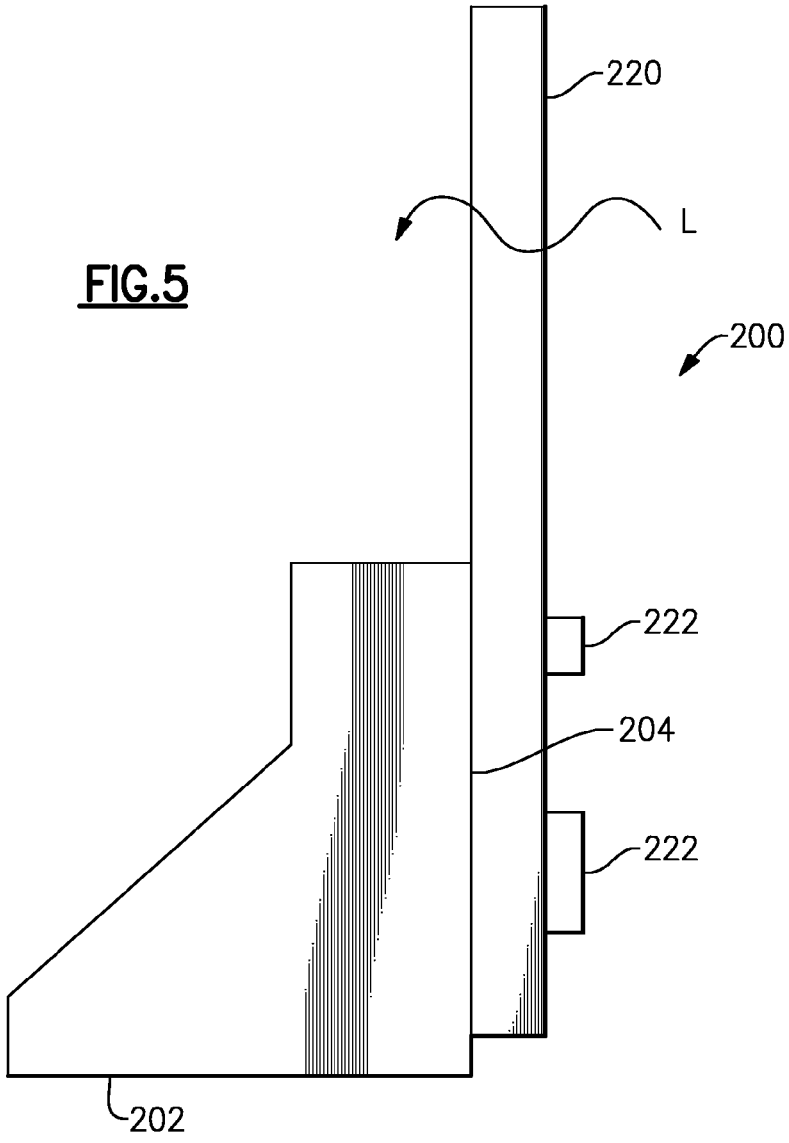
FIG. 5 is a side view of a barrier according to a third embodiment of the present invention.

FIG. 5 shows attack-resistant barrier 200, including concrete portion 202; end post 220; and fasteners 222. Although not shown, a front view of barrier 200 would look much like components 17, 20 and 21 of barrier 10, except that these components extend over flat surface 204 of concrete portion 202. As shown in FIG. 5, the concrete portion has been modified from the standard Jersey barrier shape to provide a flat mounting surface for the attack resistant device. Instead of fitting over the barrier portion as a cap, the attack resistant device is mounted to a major surface of the barrier by fasteners 222, potentially providing additional strength in the connection between the barrier portion and the attack-resistant device portion. The use of armor panels (not shown but similar to panels 17) allows light to pass thru the attack-resistant barrier in the direction of arrow L so that people protected by the barrier can see through it to the unprotected side.

DEFINITIONS

The following definitions are provided to facilitate claim interpretation:

Present invention: means at least some embodiments of the present invention; references to various feature(s) of the "present invention" throughout this document do not mean that all claimed embodiments or methods include the referenced feature(s).

First, second, third, etc. ("ordinals"): Unless otherwise noted, ordinals only serve to distinguish or identify (e.g., various members of a group); the mere use of ordinals implies neither a consecutive numerical limit nor a serial limitation.

Attack-resistant pane: Any substantially transparent window that is at least substantially resistant to ballistic and/or blast type forces; attack-resistant panes include, but are not limited to bullet-proof windows, bullet-proof shields and vehicles with bullet-proof windshields; attack-resistant panes may be made of any attack-resistant pane material now known or to be developed in the future.

Barrier: any device having suitable mass and/or anchoring and a shape such that it cannot be moved by a reasonable strong individual person; barriers include, but are not limited to: concrete barriers, Jersey barriers, Earth filled barriers, liquid filled barriers, barriers with outer walls of canvas, sand-packed barriers, gravel-filled barriers, plastic walled barriers, gel filled barriers and/or barrier designs to be developed in the future.

Mechanically connected: Includes both direct mechanical connections, and indirect mechanical connections made through intermediate components; includes rigid mechanical connections as well as mechanical connection that allows for relative motion between the mechanically connected components; includes, but is not limited, to welded connections, solder connections, connections by fasteners (for example, nails, bolts, screws, nuts, hook-and-loop fasteners, knots, rivets, force fit connections, friction fit connections, connections secured by engagement added by gravitational forces, quick-release connections, pivoting or rotatable connections, slidable mechanical connections and/or magnetic connections.

Vehicle barrier: any device having suitable mass and/or anchoring and a shape such that it is capable of at least substantially impeding the motion typical automobile across the barrier by physical interference between the typical automobile and the barrier; many barriers can stop even larger vehicles, but this is not necessarily required.

Unanchored Barrier: any barrier that is not anchored to the ground and/or a man-made structure.

To the extent that the definitions provided above are consistent with ordinary, plain, and accustomed meanings (as generally shown by documents such as dictionaries and/or technical lexicons), the above definitions shall be considered supplemental in nature. To the extent that the definitions provided above are inconsistent with ordinary, plain, and accustomed meanings (as generally shown by documents such as dictionaries and/or technical lexicons), the above definitions shall control. If the definitions provided above are broader than the ordinary, plain, and accustomed meanings in some aspect, then the above definitions shall be considered to broaden the claim accordingly.

To the extent that a patentee may act as its own lexicographer under applicable law, it is hereby further directed that all words appearing in the claims section, except for the above-defined words, shall take on their ordinary, plain, and accustomed meanings (as generally shown by documents such as dictionaries and/or technical lexicons), and shall not be considered to be specially defined in this specification. In the situation where a word or term used in the claims has more than one alternative ordinary, plain and accustomed meaning, the broadest definition that is consistent with technological feasibility and not directly inconsistent with the specification shall control.

Unless otherwise explicitly provided in the claim language, steps in method steps or process claims need only be performed in the same time order as the order the steps are recited in the claim only to the extent that impossibility or extreme feasibility problems dictate that the recited step order (or portion of the recited step order) be used. This broad interpretation with respect to step order is to be used regardless of whether the alternative time ordering(s) of the claimed steps is particularly mentioned or discussed in this document.

What is claimed:

1. An attack-resistant barrier comprising:

a cap comprising:

a barrier engaging portion configured to be secured to a cap engaging portion of a barrier member, the barrier engaging portion comprising a connecting member, and first and second side walls supported by the connecting member, the connecting member comprising a bottom surface configured to abut the barrier member, the first side wall comprising a first inner surface and a first outer surface that is opposite the first inner surface, the second side wall comprising a second inner surface facing the first inner surface, and the second side wall comprising a second outer surface that is opposite the second inner surface, wherein the bottom surface, the first inner surface, and the second inner surface collectively define a first recess that is configured to receive the cap engaging portion when the cap is secured to the barrier member; and a trough comprising a base member, and first and second trough side walls supported by the base member, the base member comprising a top surface, the first trough side wall comprising a first trough inner surface, and the second trough side wall comprising a second trough inner surface facing the first trough inner surface, such that the top surface, the first trough inner surface and the second trough inner surface collectively define a second recess; and an upper wall configured to be at least partially received within the second recess, the upper wall defining an attack side major surface and a protected side major surface, such that the attack side major surface is offset from both the first outer surface and the second outer surface when the upper wall is at least partially received within the second recess.

2. The attack-resistant barrier of claim 1, wherein the upper wall comprises an attack resistant pane that is transparent.

3. The attack-resistant barrier of claim 1, wherein the upper wall is configured to stop a bullet fired from a gun from penetrating through both the attack-side major surface and the protected side major surface.

4. The attack-resistant barrier of claim 3, further comprising the barrier member, the barrier member comprising a bottom surface, wherein the attack-resistant barrier defines a maximum height measured from the bottom surface of the barrier member to a top edge of the upper wall and the maximum height is greater than or equal to six feet.

5. The attack-resistant barrier of claim 3, wherein the upper wall comprises a top edge and a bottom edge, such that the upper wall defines a height measured from the top edge to the bottom edge, the upper wall further comprises a first side edge and a second side edge, such that the upper wall defines a width measured from the first side edge to the second side edge.

6. The attack-resistant barrier of claim 5, further comprising at least one channel member configured to receive at least one of the first side edge and the second side edge.

7. The attack-resistant barrier of claim 6, further comprising at least one armor strip secured to the attack side major surface.

8. The attack-resistant barrier of claim 3, wherein the upper wall is slidably receivable within and slidably removable from the second recess.

9. The attack-resistant barrier of claim 3, further comprising the barrier member, and wherein the barrier member comprises a jersey barrier.

10. The attack-resistant barrier of claim 1, wherein the top surface of the base member comprises a portion of the connecting member.

11. An attack-resistant barrier comprising:

a cap comprising:

a barrier engaging portion configured to be secured to a cap engaging portion of a barrier member, the barrier engaging portion comprising a first recess that is configured to receive the cap engaging portion when the cap is secured to the barrier member; and a trough comprising a base member, and first and second trough side walls supported by the base member, the first trough side wall comprising a first trough inner surface, and the second trough side wall comprising a second trough inner surface facing the first trough inner surface, such that the first trough inner surface and the second trough inner surface at least partially define a second recess; and an upper wall configured to be at least partially received within the second recess, the upper wall comprising a top edge and a bottom edge, such that the upper wall defines a height measured from the top edge to the bottom edge, the upper wall further comprising an attack side major surface and a protected side major surface opposite the attack side major surface, the attack side major surface and the protected side major surface each extending from the top edge to the bottom edge;

wherein the upper wall is at least partially receivable within the second recess such that the first trough inner surface faces the attack side major surface, and the second trough inner surface faces the protected side major surface.

12. The attack resistant barrier of claim 11, wherein the barrier engaging portion comprises a connecting member, and first and second side walls supported by the connecting member, the connecting member comprising a bottom surface configured to abut the cap engaging portion, the first side wall comprising a first inner surface, the second side wall comprises a second inner surface facing the first inner surface, and the bottom surface, the first inner surface, and the second inner surface collectively defining the first recess.

13. The attack resistant barrier of claim 12, wherein the first side wall comprises a first outer surface opposite the first inner surface, the second side wall comprises a second outer surface opposite the second inner surface, and the attack side major surface is offset from both the first outer surface and the second outer surface when the upper wall is at least partially received within the second recess.

14. The attack-resistant barrier of claim 11, wherein the upper wall comprises an attack resistant pane that is transparent.

15. The attack-resistant barrier of claim 11, wherein the upper wall is configured to stop a bullet fired from a gun from penetrating through both the attack-side major surface and the protected side major surface.

16. The attack-resistant barrier of claim 15, further comprising at least one channel member, wherein the upper wall comprises a first side edge and a second side edge, and the at least one channel member is configured to receive at least one of the first side edge and the second side edge.

17. The attack-resistant barrier of claim 16, further comprising at least one armor strip secured to the attack side major surface.

18. The attack-resistant barrier of claim 14, further comprising the barrier member, and wherein the barrier member comprises a jersey barrier.

19. The attack-resistant barrier of claim 11, wherein the base member further comprises a top surface that partially defines the second recess, and the upper wall is at least partially receivable within the second recess such that the top surface faces the bottom edge.

20. The attack-resistant barrier of claim 19, wherein the top surface of the base member comprises a portion of the connecting member.

* * * * *